United States Patent [19]

Sakashita

[11] 3,977,290

[45] Aug. 31, 1976

[54] ELECTRONIC MUSICAL INSTRUMENT

[75] Inventor: Noriji Sakashita, Hamamatsu, Japan

[73] Assignee: Kabushiki Kaisha Kawai Gakki Seisakusho, Hamamatsu, Japan

[22] Filed: Mar. 5, 1975

[21] Appl. No.: 555,620

[52] U.S. Cl. ..... 84/1.01; 84/DIG. 10; 84/DIG. 11

[51] Int. Cl.[2] ..... G10H 1/00; G10H 5/06

[58] Field of Search ..... 84/1.01, 1.03, 1.22–1.24, 84/DIG. 11, DIG. 10

[56] References Cited

UNITED STATES PATENTS

| | | | |
|---|---|---|---|
| 3,236,931 | 2/1966 | Freeman | 84/1.23 |
| 3,499,091 | 3/1970 | Bunger | 84/1.03 |
| 3,629,482 | 12/1971 | Pulfer et al. | 84/1.03 |
| 3,819,844 | 6/1974 | Isii | 84/1.03 X |
| 3,840,691 | 10/1974 | Okamoto | 84/1.03 |
| 3,842,702 | 10/1974 | Tsundoo | 84/1.01 |

*Primary Examiner*—L. T. Hix
*Assistant Examiner*—Stanley J. Witkowski
*Attorney, Agent, or Firm*—Haseltine, Lake & Waters

[57] ABSTRACT

An electronic musical instrument in which a plurality of order pulse generators and a plurality of musical-tone-waveform forming circuits are connected in order to a tone-source-signal pulse generator. Interposed in each of a plurality of circuits diverging from the output terminal of the tone-source-signal pulse generator to the order pulse generators is a pulse-counter circuit which has a variable frequency-dividing ratio. On the output side of the pulse-counter circuit, a frequency-dividing ratio-setting signal-generating counter circuit is provided which generates a signal for setting the frequency-dividing ratio thereof.

10 Claims, 6 Drawing Figures

PROR ART

ELECTRONIC MUSICAL INSTRUMENT

FIELD OF THE INVENTION

This invention relates to electronic musical instruments.

BACKGROUND

There has previously been developed a type of electronic musical instrument in which a tone-source-signal pulse generator, a plurality of order pulse generators and a plurality of musical-tone-waveform forming circuits are connected in order. The plurality of order pulse generators each comprises an address counter, which is composed of a plurality of frequency-dividers, each having a frequency-dividing ratio of two, connected in series with one another so that a number of frequency-divided pulses are generated at output terminals of those dividers. Each order pulse generator also includes a matrix circuit which serves to decode those frequency-divided pulses to take out in order from its respective output terminals pulses *l* to *n*.

The musical-tone-waveform forming circuits each comprises a musical-tone-waveform memory circuit which has a sampling number (set values previously memorized are read and are converted into digital signals constituting output signals) corresponding to the above-mentioned order pulses *l* to *n*, and a D-A converter which serves to convert those digital signals obtained in order by the order pulses into an analog signal for forming a musical-tone waveform.

Thus, if the pulse oscillation frequency of the tone-source-signal pulse generator in the known arrangement is *f*, the output signal thereof is constituted by a series of pulses which are decoded by the order pulse generators to generate repeatedly the order pulses *l* to *n* which are applied as an input to each musical-tone-waveform forming circuit, whereby each signal musical-tone waveform is formed by the order pulses from *l* to *n*, and thus there can be obtained a musical-tone signal of the frequency *f*/*n* as a whole. The above has been already disclosed in U.S. Pat. No. 3,515,792.

With this known arrangement, in order to obtain musical-tone signals extending over a wide octave range, the oscillation frequency of the tone-source-signal pulse generator must be as high as 2.00024 MHz, for instance, and the number *n* of the order pulses in each of the order pulse generators must be made, respectively, 239, 253 . . . 451, 478 . . . .

The fact that the number *n* is so varied as indicated above results in defects such that the sampling number of the musical-tone-waveform memory circuit in each of the musical-tone-waveform forming circuits is not only differentiated from one another but also is considerably large in number. Thus the manufacturing and setting thereof becomes troublesome.

If it is now established that the sampling number of the musical-tone-waveform memory circuit is 32, the number of order pulses also becomes 32, and one cycle of musical-tone waveform is formed by thirty-two input pulses. This is equal to the result that the frequency-dividing ratio is 32. If, then, it is assumed that the sampling number is 32 and the finally required frequency-dividing ratio is 239, it will be clearly appreciated that, in the case where a pulse counter of a frequency-dividing ratio of 7.46 is provided between the order pulse generator and the tone-source signal-pulse generator, the whole frequency-dividing ratio becomes 239 and thereby the correct frequency for the musical-tone signal can be obtained. However, a pulse counter with such a frequency-dividing ratio can not be readily made. If, therefore, the frequency-dividing ratio thereof is conveniently fixed to be 8, the whole frequency-dividing ratio becomes $8 \times 32 = 256$, and thus there is caused such an inconvenience that the resultant signal becomes 7813.43 Hz in frequency, whereas the correct frequency thereof should be 8360.21 Hz. There is a large error therebetween and the resultant musical tone is not fit for hearing.

SUMMARY OF THE INVENTION

This invention has as an object the provision of an electronic musical instrument free from the above difficulties and having a smaller sampling number.

According to the present invention, in an electronic musical instrument of the type in which a plurality of order pulse generators and a plurality of musical-tone-waveform forming circuits are connected in order to a tone-source-signal pulse generator, there is interposed, in each circuit diverging from the output terminal of the tone-source-signal pulse generator to the plurality of order pulse generators, a pulse counter circuit which is variable in its frequency-dividing ratio and there is provided, on the output side of the pulse counter circuit, a frequency-dividing ratio-setting signal-generating circuit which counts the number of output pulses of the pulse counter circuit and generates a signal for selecting or setting the frequency-dividing ratio thereof.

BRIEF DESCRIPTION OF DRAWING

Examples of this invention will next be explained with reference to the accompanying drawings in which.

DETAILED DESCRIPTION

Figure 1:
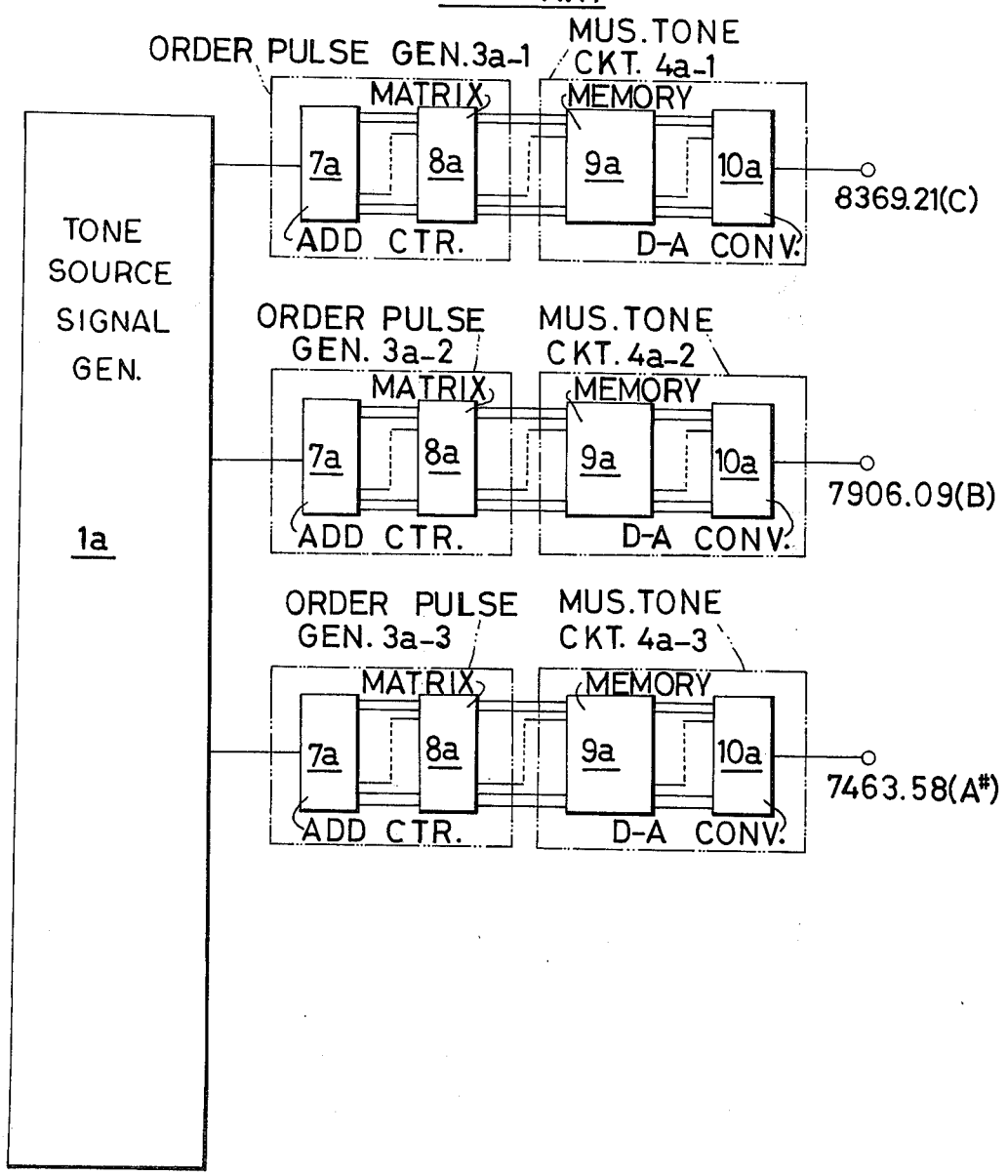
FIG. 1 is a block diagram showing an example of a conventional electronic musical instrument of the prior art.

According to the prior art, there is known a type of electronic musical instrument such as shown in FIG. 1. This instrument is constructed to include a tone-source-signal pulse generator 1*a*, a plurality of order pulse generators 3*a*-1, 3*a*-2 . . . 3*a*-n, and a plurality of musical-tone-waveform forming circuits 4*a*-1, 4*a*-2 . . . 4*a*-n connected in parallel branches in series.

The order pulse generators 3*a*-1, 3*a*-3 . . . 3*a*-n are of a type each comprising an address counter 7*a* which is composed of a plurality of frequency-dividers. Each of these frequency-dividers has a frequency-dividing ratio of 2, and are connected in series with one another so that a number of frequency-divided pulses are generated at the output terminals thereof, each order pulse generator also includes a matrix circuit 8*a* which serves to decode these frequency-divided pulses to take out an order from its respective output terminals, pulses *l* to *n*.

9a The musical-tone-waveform forming circuits 4a-1, 4a-2 . . . 3a-n are of a type whereby each comprises a musical-tone-waveform memory circuit 9a which has a sampling number corresponding to the above-mentioned order pulses *l* to *n*. They also comprise a D-A converter 10a which serves to convert these digital signals into analog signals for forming a musical-tone waveform.

Figure 2:
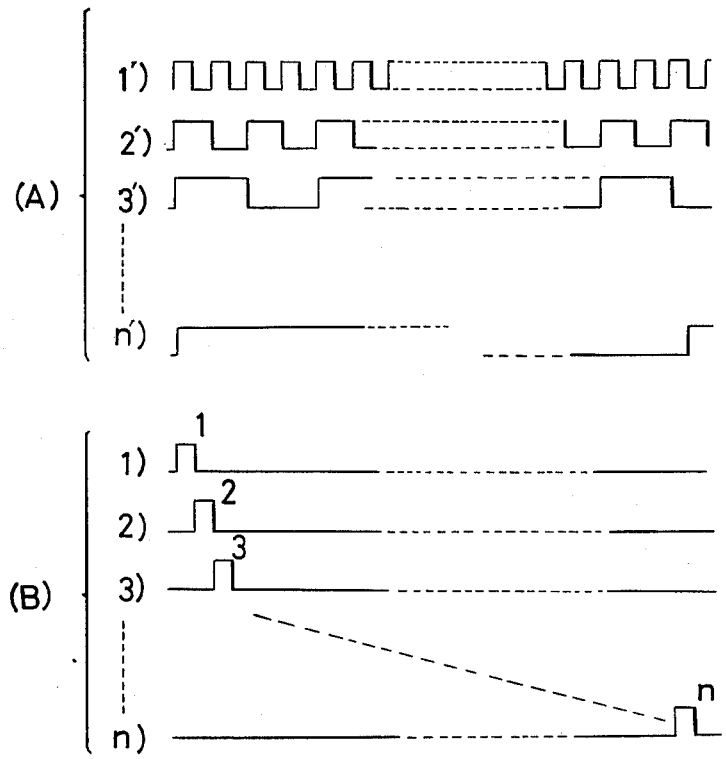
FIG. 2 is a waveform diagram explaining the operation of the instrument of FIG. 1.

The circuit 1 *a* in FIG. 1 corresponds to the frequency synthesizer in FIG. 1 of U.S. Pat. No. 3,515,792. The circuits 3a-1 3a-2 . . . 3a-n each including the circuits 7a and 8a in U.S. Pat. No. 3,515,792. These circuits 7a and 8a are known, for instance, as the circuits 100 and 130 in FIG. 1 of U.S. Pat. No. 3,752,898. The circuit 7a comprises an address counter and the circuit 8a comprises a matrix counter. The plurality of output terminals of the circuit 7a generate output signals 1', 2', 3'. . . in FIG. 2(A), and the circuit 8a is fed these signals 1', 2', 3'. . . as inputs. It is repeated that, from the first one of the output terminals thereof, pulses are generated as shown by 1, 2, 3 . . . *n* in FIG. 2(B). This is not different from the ring counter.

The circuits 9a and 10a are equivalent to one side of the circuit 60 and the circuit 30 in U.S. Pat. No. 3,515,792. The circuit 60 is a memory circuit comprising a diode matrix circuit and the circuit 30 is a DIGITAL-TO-ANALOG CONVERTER (D-A converter).

If the pulse oscillation frequency of the tone-source-signal pulse generator in the known arrngement is *f*, the output signal thereof is constituted by a series of pulses which are decoded by the order pulse generators 3a-1, 3a-3 . . . 3a-n to generate repeatedly the order pulses *l* to *n* which are applied as an input to each musical-tone-waveform forming circuit 4a-1, 4a-2 . . . 4a-n whereby each signal musical-tone waveform is formed by the order pulses from *l* to *n*. Thus, there can be obtained a musical-tone signal of the frequency *f/n* as a whole.

In order to obtain musical-tone signals extending over a wide octave range, the oscillation frequency of the tone-source-signal pulse generator 1a must be as high as 2.00024 MHz, for example, and the number *n* of the order pulses in each of the order pulse generators 2a-1, 2a-2 . . . 2a-n must be made respectively 239, 253, 268 . . . 451, 478 . . . .

The fact that the number *n* is varied as indicated above results in defects such that the sampling number of the musical-tone-waveform memory circuit 9a in each of the musical-tone-waveform forming circuits 4a-1, 4a-2 . . . 4a-n is not only differentiated from one another, but is also a substantially larger number.

If the sampling number of the musical-tone-waveform memory circuit 9a is 32, the number of order pulses also becomes 32 and one cycle of musical-tone waveform is formed by 32 input pulses. This is equal to the result that the frequency-dividing ratio is 32. If it is then assumed that the sampling number is 32 and the finally required frequency-dividing ratio is 239, it will be readily appreciated that where a pulse counter of a frequency-dividing ratio of 7.46 is provided between the order pulse generator and the tone-source signal pulse generator 1a, the whole frequency-dividing ratio becomes 239, which is a correct frequency for the musical-tone signal.

However, a pulse counter with such a frequency-dividing ratio cannot be readily made. If the frequency-dividing ratio is conveniently fixed to be 8, the frequency-dividing ratio becomes $8 \times 32 = 256$. Thus, the resultant signal becomes 7813.43 Hz in frequency, whereas the correct frequency should be 8360.21 Hz. This is a large error, and the resultant musical-tone is not fit for hearing. The invention provides for overcoming this problem.

Figure 3:
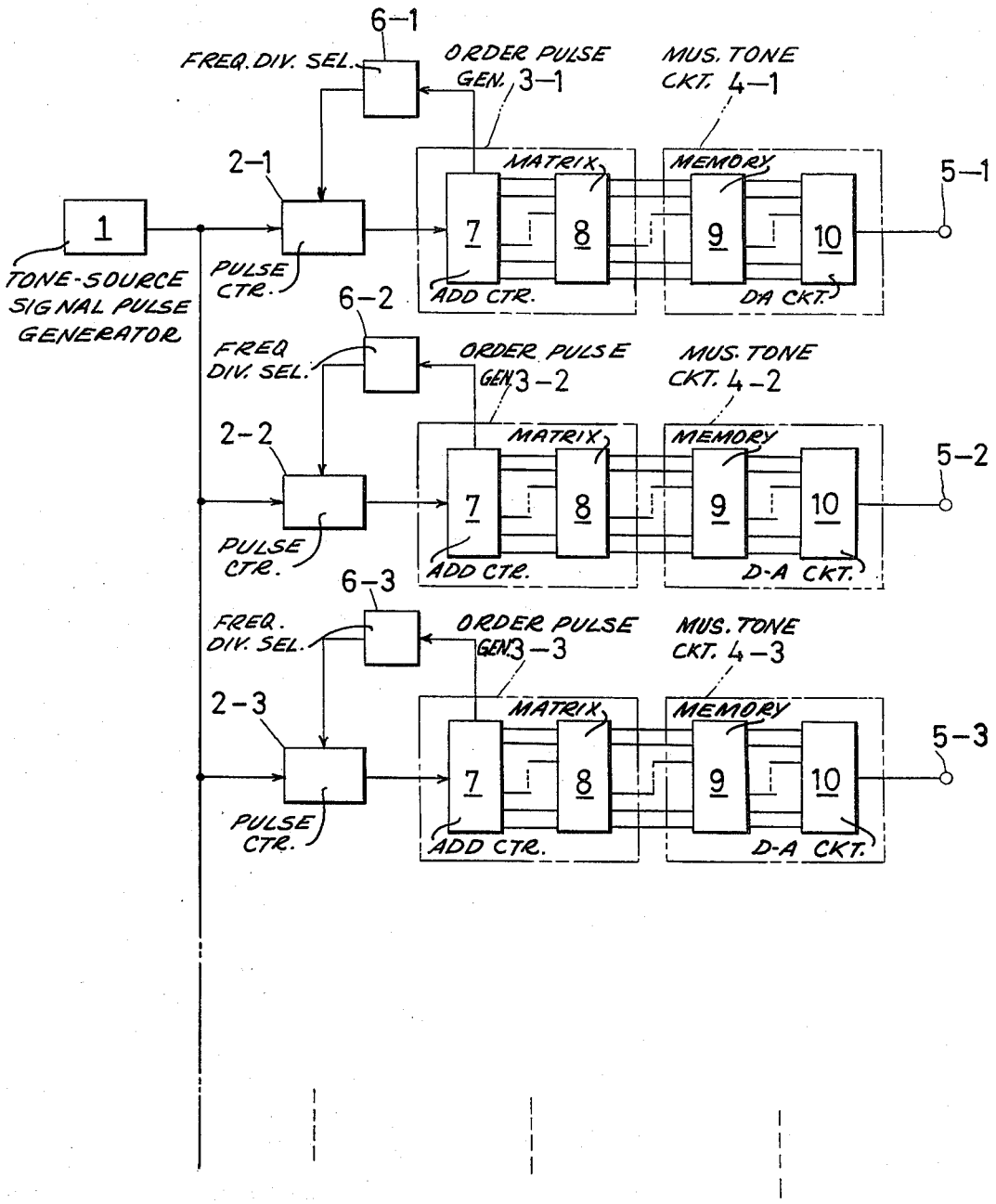
FIG. 3 is a block diagram showing an electronic musical instrument according to one embodiment of this invention.

Referring to FIG. 3, which illustrates one embodiment of the invention, circuit 1 is a tone-source-signal pulse generator, circuits 2-1, 2-2 . . . 2-n are pulse-counter circuits, each being variable in frequency-dividing ratio, connected in parallel with one another to the output terminal of the generator 1, and circuits 3-1, 3-2 . . . 3-n are order pulse generators connected to the output sides of the respective pulse-counter circuits 2-1, 2-2 . . . 2-n to serve to decode the input pulses therefrom and generate pulses in order from the output terminals thereof. Circuits 4-1, 4-2 . . . 4-n are musical-tone waveform forming circuits connected to the output sides of the respective order pulse generators 3-1, 3-2 . . . 3-n, so that each serves to form a single musical-tone waveform depending on the set value at one cycle of the afore-mentioned order pulses. Elements 5-1, 5-2 . . . 5-n are output terminals of the musical-tone waveform forming circuits 4-1, 4-2 . . . 4-n and circuits 6-1, 6-2 . . . 6-n are frequency-dividing ratio setting, signal generating circuits for generating frequency-dividing ratio setting or selector signals for the foregoing pulse counter circuits 2-1, 2-2 . . . 2-n.

Each of order pulse generators 3-1, 3-2 . . . 3-n comprises an address counter 7 and a matrix circuit 8 in almost the same manner as in the conventional arrangements mentioned above, but is different therefrom in that the number of the component parts thereof is small and the number of the output terminals thereof is also quite small and is from about 10 to 40.

Each of the musical-tone waveform forming circuits 4-1, 4-2 . . . 4-n comprises a musical-tone-waveform memory circuit 9 and a D-A (digital-to-analog) circuit 10 in almost the same manner as in the above-described conventional arrangement, but is comparatively simple such that the number of the component parts thereof is small and the sampling number is from about 10 to 40.

If the sampling number of the musical-tone-waveform memory circuit 9 is set to be 32, the order pulse generators 3-1, 3-2 . . . 3-n may each be enough with 32 output terminals.

Thus, by one cycle of the order pulses decoded by each order pulse generator 3-1, 3-2 . . . 3-n, that is, by 32 pulses, a single musical-tone signal can be obtained from each of the output terminals 5-1, 5-2 . . . 5-n of the musical-tone-waveform forming circuits 4-1, 4-2 . . . 4-n. This is equivalent to that the frequency-dividing ratio is 32.

Each of the variable frequency-dividing ratio type pulse counter circuits 2-1, 2-2 . . . 2-n has a frequency-dividing ratio setting circuit for setting the frequency-dividing ratio thereof. Each of the frequency-dividing ratio setting, signal generating circuits 6-1, 6-2 . . . 6-n comprises a circuit which counts the output of the associated address counter 7 to generate a frequency-dividing ratio setting signal.

A frequency-dividing ratio *m* corresponding to the sampling number of the musical-tone-waveform memory circuit 9 is next considered to be divided into two as follows:

$$m = X + Y \qquad 1.$$

If it is arranged that the frequency-dividing ratio of each pulse counter circuit 2-1, 2-2 . . . **2-*n*** can be changed between n and n+1, the frequency-dividing ratio A obtained becomes $$A = X \cdot n + Y(n + 1) \qquad 2.$$

If it is then established that A = 239, $m$ =32, X = 17 and Y = 15, it follows that $n = 7$ and $n + 1 = 8$.

Accordingly, if operation of the pulse counter circuit 2-1 is repeated 17 times with the frequency-dividing ratio of 7 by one output of the frequency-dividing ratio setting signal generating circuit 6-1 and then the operation is repeated fifteen times with the frequency-dividing ratio of 8 by the other output, the frequency-dividing ratio as a whole becomes the correct number 239. Thereby, a correct-frequency musical-tone signal can be obtained.

The circuits 7, 8, 9 and 10 in FIG. 3 are equivalent to the circuits **7*a*, 8*a*, 9*a* and 10*a* in FIG. 1.**

Figure 4:
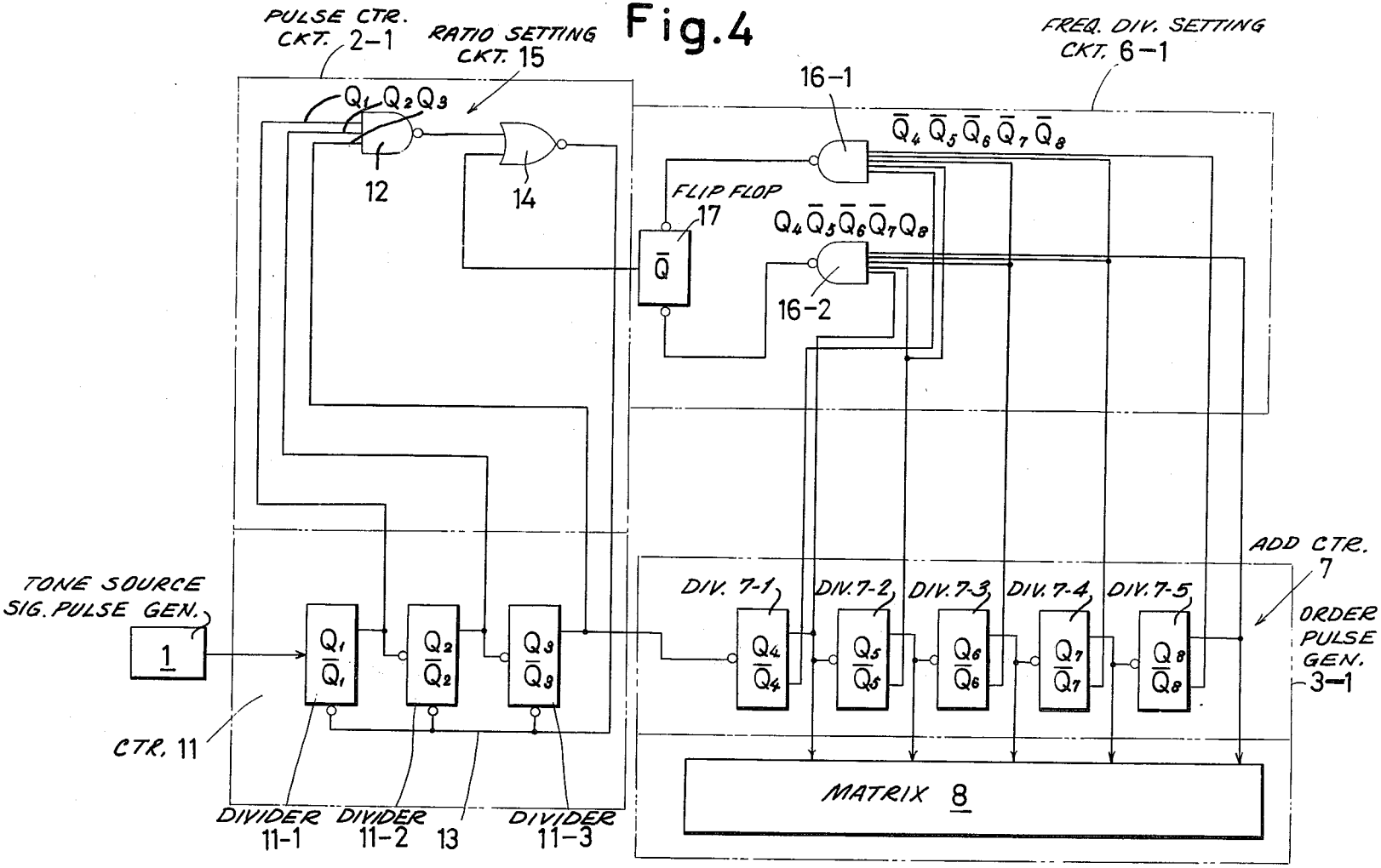
FIG. 4 is a logical diagram showing the details of a portion thereof.

FIG. 4 is a circuit diagram showing an example as applied to the frequency-dividing ratio of 239 as a whole. Specifically, the variable frequency-dividing ratio type pulsecounter circuit 2-1 comprises a counter circuit 11 which is composed of three frequency-dividers 11-1, 11-2 and 11-3, each having a frequency-dividing ratio of 2, and a frequency-dividing ratio setting circuit 15 which is composed of a NAND circuit 12 connected to output terminals Q1, Q2, Q3 of the dividers 11-1, 11-2 and 11-3 and a NOR gate 14 which is connected at its input side to the output terminal of the NAND gate 12 and an output terminal of the frequency-dividing-ratio setting-signal generating circuit 6-1 and is connected at its output side to a common reset terminal 13 for the frequency-dividers 11-1, 11-2 and 11-3 . . . **11-*n***.

The frequency-dividing ratio-setting signal-generating circuit 6-1 comprises a first NAND gate 16-1 connected to respective output terminals $\overline{Q4}$, $\overline{Q5}$, $\overline{Q6}$, $\overline{Q7}$ and $\overline{Q8}$ of five frequency dividers 7-1 . . . 7-5, each having a frequency-dividing ratio of 2, constituting the address counter 7, a second NAND gate 16-2 connected to output terminals Q4, $\overline{Q5}$, $\overline{Q6}$, $\overline{Q7}$ and Q8 and a RS flip-flop circuit 17 connected to the output terminals of NAND gates 16-1 and 16-2. The output terminal Q of the flip-flop circuit 17 is connected to the input side of the NOR gate 14.

Each of the frequency-dividers 11-1 . . . 11-3 and 7-1 . . . 7-5 is so constructed as to be brought to its reset condition when the electric power source (not shown) is ON.

FIG. **5*a* shows an output signal of the tone-source-signal pulse generator; FIGS. 5*b* — 0 show output signals of the dividers 11-1 . . . 11-3 and 7-1 . . . 7-5; FIG. 5*p* shows an output signal of the 2nd NAND circuit 16-2; FIG. 5*q* shows an output signal of the first NAND circuit 16-1; and FIG. 5*r*** shows an output signal of the RS flip-flop circuit.

Figure 5:
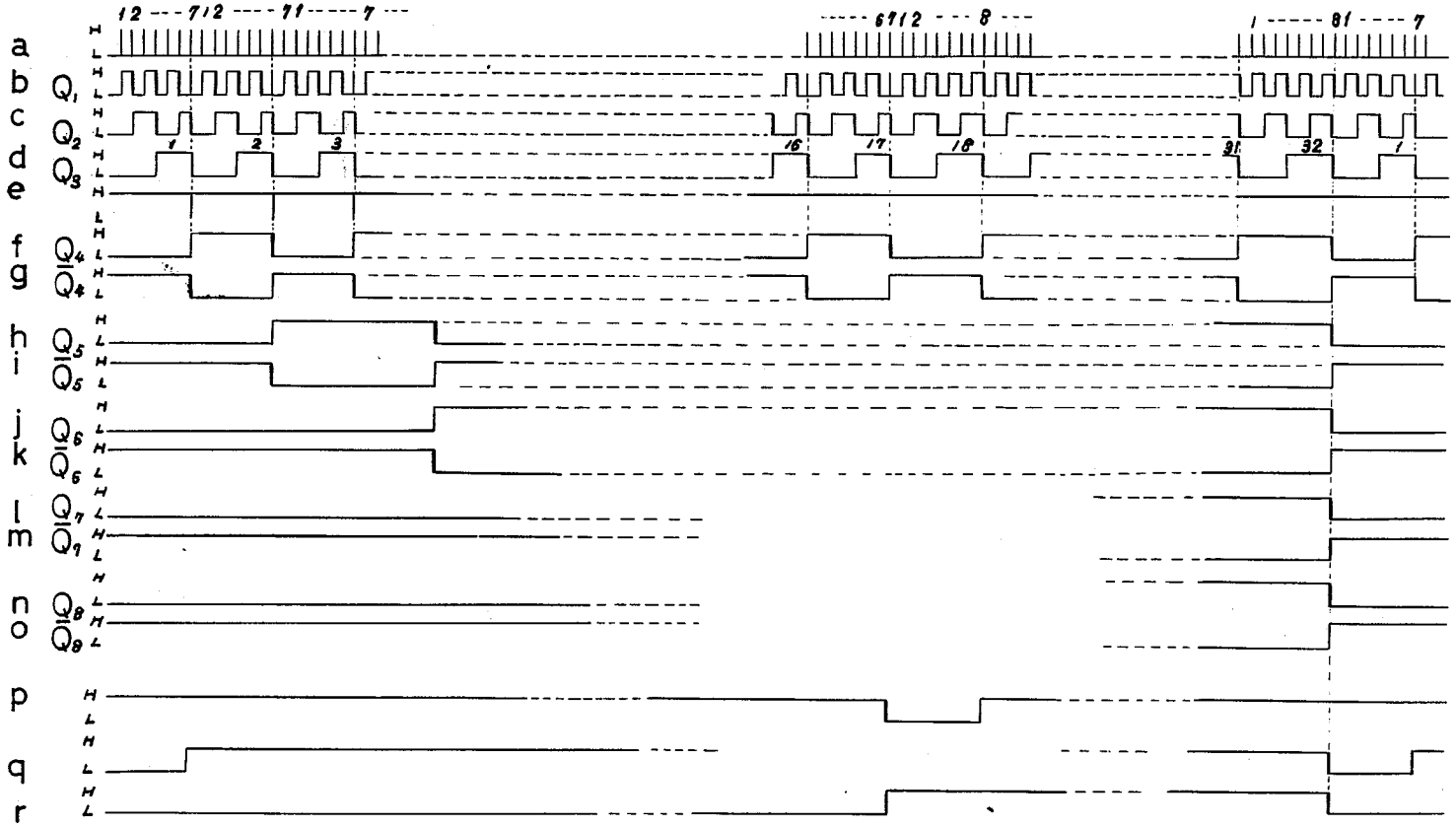
FIG. 5 is a waveform diagram for explaining the operation thereof.

If, thus, the electric power source is ON, the potential of the output terminal of the first NAND gate 16-1 of the frequency-dividing ratio-setting signal-generating circuit 6-1 goes to L as shown in FIG. 5 (*q*), and the potential of the output terminal $\overline{Q}$ of the flip-flop circuit 17 goes to L as shown in FIG. 5(*r*). If, then, a series of pulses FIG. 5(*a*) is applied as an input to the counter circuit 11 from the tone-source-signal pulse generator 1 and seven pulses are counted thereby, a signal L as shown in FIG. 5 is taken from the output terminal of the NAND gate 12 of the frequency-dividing ratio-setting circuit 14, and by the cooperation thereof with the output L of the flip-flop circuit 17, the output terminal of the NOR gate 14 goes to the H potential. Thereby the frequency-dividers 11-1. 11-2 and 11-3 are reset to return to the initial condition. During this period, from the output terminal Q3 of the last stage frequency-divider 11-3, a single pulse as shown in FIG. 5 *d* is taken out and is applied as an input to the address counter 7.

If it is repeated seventeen times that a single pulse is generated each time seven pulses are counted, it results that seventeen pulses are applied to the address counter 7. On completion of counting of the 17 pulses at the address counter 7, the output terminal of the second NAND gate 16-2 of the frequency-dividing ratio setting signal generating circuit 6-1 becomes L as shown in FIG. 5 *p* and thereby the RS flip-flop circuit 17 is reversed. The potential of the output terminal $\overline{Q}$ thereof becomes H as shown in FIG. 5 *r*. Even if, thus, the counter circuit 11 counts seven pulses and the output terminal of the NAND gate 12 becomes L, the output terminal of the NOR gate 13 is maintained at L in its potential. Thereby, the counter circuit is prevented from being reset.

On counting the eighth pulse, the counter circuit 11 is automatically reset and generates a single pulse from the output terminal Q3. When fifteen pulses are generated from the counter circuit 11 and the address counter 7 counts 32 pulses (that is, the sum total of the same and the foregoing seventeen pulses) the output terminal of the first NAND gate 16-1 again becomes L as shown in FIG. 5 *q* and the NOR gate 14 has the L applied thereto, whereby a single output is generated by seven input pulses as mentioned above. Thereafter, this is repeated in almost the same manner as above.

As a result of the fact that the 17-times counting with the frequency-dividing ratio of 7 and the fifteen-times counting with the ratio of 8 are carried out and that the frequency-dividing ratio of the musical-tone-waveform forming circuit 4-1 is 32, the frequency-dividing ratio as a whole becomes 239 and thereby a correct-frequency musical-tone signal can be obtained as mentioned above.

The Table below shows the setting condition of the frequency-dividing ratio of the pulse-counter circuits 2-1, 2-2 . . . **2-*n* for each tone pitch. The pulse-counter circuit 2-1 is as mentioned above. The pulse-counter cicuit 2-2 is so arranged in the frequency-dividing ratio-setting circuit 14 and the frequency-dividing ratio-setting signal-generating circuit 6-2** that generation of a single output pulse by seven input pulses is repeated three times and then generation of a single output pulse by eight input pulses is repeated 29 times. Thereby, the frequency-dividing ratio as a whole becomes the correct number of 253.

The pulse counter circuit 2-3 is so arranged in the circuits 14 and 6-3 that generation of a single output pulse by eight input pulses is repeated 20 times and generation of a single output pulse by nine input pulses is repeated 12 times. Thereby, the whole frequency-dividing ratio becomes the correct number of 268.

Figure 6:
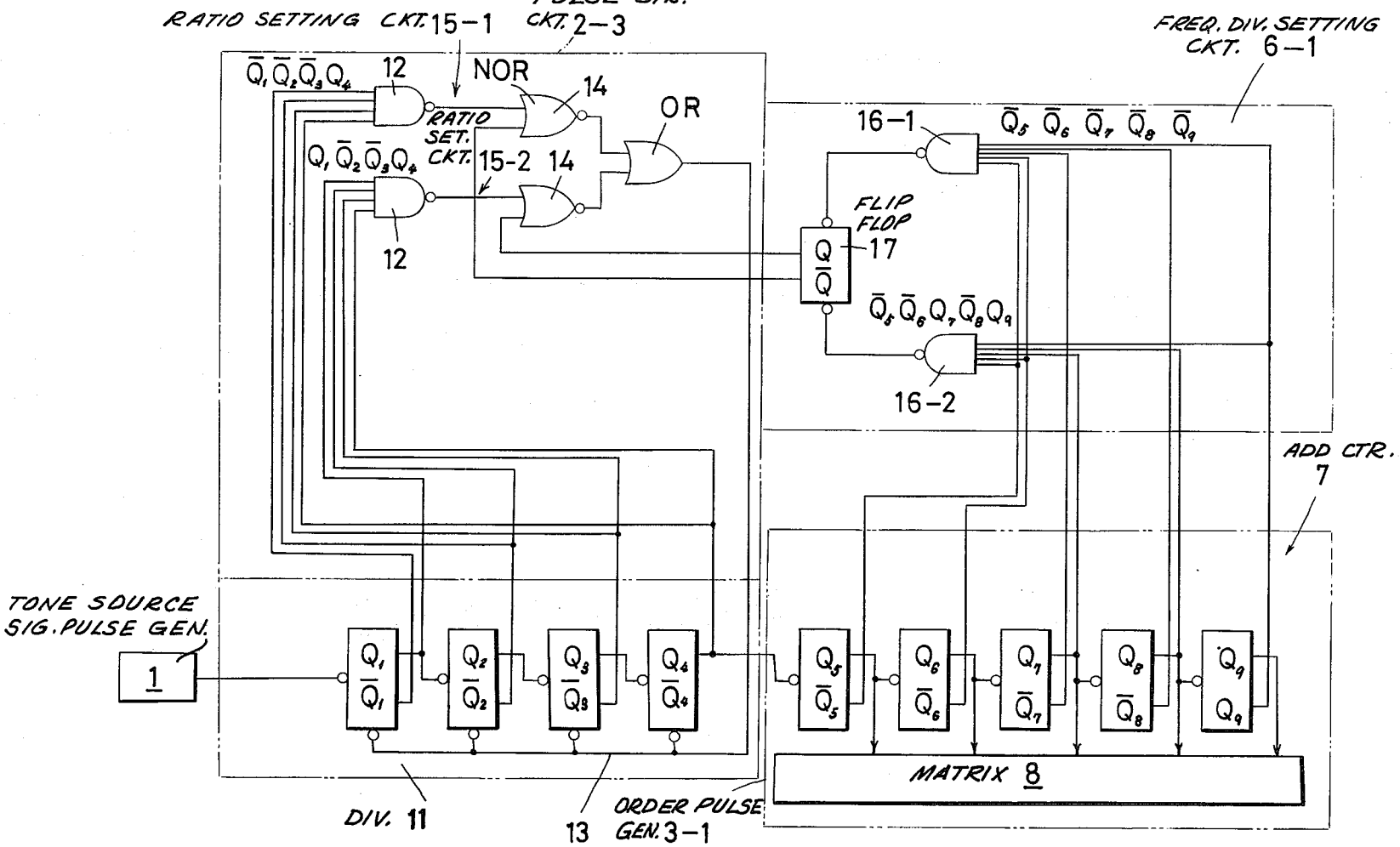
FIG. 6 is a diagram showing the details of another portion of the same.

The frequency-dividing ratio of the counter circuit 11 can be fixed by $2^m$, where $m$ is the number of the frequency-dividers. In case the frequency-dividing ratio is to be set at nine or more, four frequency-dividers are required. A detailed circuit diagram thereof is shown in FIG. 6. In this case, the frequency-dividing ratios are 8 and 9, so that resetting must be provided for each of them.

Accordingly, two frequency-dividing ratio-setting circuits 15-1 and 15-2 are required and these are to be reset alternately. This is different from the case of the pulse counter circuits 2-1 and 2-3 mentioned above. Similarly, the remainder of the pulse-counter circuits 2-3 and 2-4 . . . **2-*n* are set in accordance with the arrangements as shown in the Table below. Similar to the foregoing, the counter circuit 11** has one frequency-divider added each time it goes above $2^6$, $2^7$ . . . $2^n$.

Table

| Pulse counter circuit No. | Finally obtained correct frequency-dividing ratio A | Frequency-dividing ratio n | Pulse number X | Frequency-Dividing ratio n + 1 | Pulse Number Y | Sampling number |
|---|---|---|---|---|---|---|
| 2–1 | 239 | 7 | 17 | 8 | 15 | 32 |
| 2–2 | 253 | 7 | 3 | 8 | 29 | " |
| 2–3 | 268 | 8 | 20 | 9 | 12 | " |
| 2–4 | 284 | 8 | 4 | 9 | 28 | " |
| 2–5 | 301 | 9 | 19 | 10 | 13 | " |
| 2–6 | 319 | 9 | 1 | 10 | 31 | " |
| 2–7 | 338 | 10 | 14 | 11 | 18 | " |
| 2–8 | 358 | 11 | 26 | 12 | 6 | " |
| 2–9 | 379 | 11 | 5 | 12 | 27 | " |
| 2–10 | 402 | 12 | 14 | 13 | 18 | " |
| 2–11 | 426 | 13 | 22 | 14 | 10 | " |
| 2–12 | 451 | 14 | 29 | 15 | 3 | " |
| . | . | . | . | . | . | . |
| . | . | . | . | . | . | . |
| . | . | . | . | . | . | . |
| . | . | . | . | . | . | . |
| . | . | . | . | . | . | . |

The above has been explained with reference to the case where the frequency-dividing ratio is divided into two, (that is, $n$ and $n+1$) but this invention can be also carried out by a dividing into 3 (such as $n$, $n+1$, $n+2$) or more, or into $n$, $n+w$ ($w=2, 3 \ldots$) by increasing the output number of the frequency-dividing ratio-setting circuit and of the frequency-dividing ratio-setting signal generating circuit. To sum up, it is only required that an error be so distributed as to obtain a desired and correct frequency-dividing ratio as a whole.

The above has been explained with reference to the case of the sampling number of 32, but it will be easily understood from the foregoing principle that the sampling number is discretionary and can be selected to be from 10 to 40.

Thus, according to the invention, there is the pulse-counter circuit which is variable in its frequency-dividing ratio and the frequency-dividing ratio-setting signal-generating circuit which counts the output pulses of the pulse-counter circuit and generates a signal for properly setting the frequency-dividing ratio thereof, so that, by properly varying the frequency-dividing ratio of the pulse-counter circuit, the order pulse counter circuit connected to the output side thereof can have an input pulse signal of correct frequency applied thereto. Thereby, a correct frequency for a musical-tone signal can be obtained.

Additionally, respective musical-tone-waveform memory circuits can be set to be constant or equal in sampling number. Thereby, the setting of the sampling can be extremely facilitated. Additionally, if the frequency-dividing ratio of the pulse-counter circuit is varied to $n$, $n+1$, so, for instance, as to make the smallest possible difference therebetween, the output pulses from the counter circuit can be extremely small in variation of pulse width, so that it is not necessary to take such a variation especially into consideration at the time of sampling. Thereby, the setting thereof can be facilitated.

What is claimed is:

1. An electronic musical instrument comprising tone-source signal pulse generative means, a plurality of musical-tone generating means to generate respective musical tones, a plurality of pulse counting means coupled to said pulse generating means and adapted to generate output signals corresponding to respective of said tones, a plurality of order pulse generating means coupled between respective of said pulse counting means and said musical-tone generating means to control the latter to generate said musical tones, said pulse counting means having variable frequency-dividing ratios controlling the signals fed by the pulse counting means to the order pulse generating means, and a frequency-dividing ratio setting means coupled in feedback relation between said order pulse generating means and said pulse counting means to control the latter.

2. An instrument as claimed in claim 1 wherein the ratio of each said pulse counting means varies between $n$ and $n+1$ wherein $n$ is an integral number.

3. An instrument as claimed in claim 1 wherein each musical-tone generating means includes a musical-tone-waveform generating circuit characterized by a sampling number between 20 to 40, said sampling number being the number of words in said musical-tone-waveform generating circuit.

4. An instrument as claimed in claim 1 wherein each of the musical-tone generating means includes a digital-to-analog tone generating circuit and a musical-tone-waveform memory coupled thereto characterized by a sampling number between 20 and 40 said sampling number being the number of words in said memory.

5. An instrument as claimed in claim 4 wherein each of said order pulse generating means includes a matrix coupled to and controlling the memory in the corresponding musical-tone generating means and an address counter coupled between said matrix and the corresponding pulse counting means.

6. An instrument as claimed in claim 5 wherein each ratio setting means is coupled between the corresponding address counter and pulse counting means.

7. An instrument as claimed in claim 6 wherein each pulse counting means includes a plurality of divider circuits connected in series and each address counter includes a plurality of divider circuits connected in a series arrangement connected in series to the series of divider circuits in the corresponding pulse counting means.

8. An instrument as claimed in claim 7 wherein each said ratio setting means includes a plurality of gates selectively coupled to the divider circuits therein to selectively generate reset signals which are fed to the divider circuits in the corresponding pulse generating means.

9. An instrument as claimed in claim 8 wherein each said pulse counting means including at least one gate selectively coupled to the divider circuits therein to selectively generate reset signals which are fed back to the latter said divider circuits.

10. An instrument as claimed in claim 9 wherein said ratio setting means includes a flip flop connected to and operated by the gates therein to generate the reset signal thereof.

* * * * *